US006968879B2

(12) United States Patent
Schuh et al.

(10) Patent No.: US 6,968,879 B2
(45) Date of Patent: Nov. 29, 2005

(54) KNIFE AND APPARATUS FOR CLAMPING A KNIFE

(75) Inventors: Loren R. Schuh, Battle Ground, WA (US); Tobias L. Simonsen, Vancouver, WA (US)

(73) Assignee: Key Knife, Inc., Tualatin, OR (US)

( * ) Notice: Subject to any disclaimer, the term of this patent is extended or adjusted under 35 U.S.C. 154(b) by 201 days.

(21) Appl. No.: 09/918,895

(22) Filed: Jul. 30, 2001

(65) Prior Publication Data

US 2003/0019543 A1 Jan. 30, 2003

(51) Int. Cl.[7] ..... B27C 1/00

(52) U.S. Cl. ..... 144/174; 144/176; 144/218; 144/241; 241/92

(58) Field of Search ..... 144/162.1, 176, 144/218, 230, 241, 172–174, 220; 241/91–93, 241/189.1, 278.1, 292.1, 296, 298; 407/30, 407/35, 49, 80, 91, 107, 108, 41, 51

(56) References Cited

U.S. PATENT DOCUMENTS

| | | | | | |
|---|---|---|---|---|---|
| 1,222,871 | A | | 4/1917 | Jesseph | |
| 3,780,778 | A | | 12/1973 | Chapman | |
| 3,838,724 | A | * | 10/1974 | Buchacher et al | 144/230 |
| 3,976,112 | A | | 8/1976 | Rowlson et al. | |
| 3,981,337 | A | | 9/1976 | Sundstrom | |
| 3,989,077 | A | * | 11/1976 | Humbert | 144/230 |
| 4,047,670 | A | | 9/1977 | Svensson | |
| 4,220,186 | A | * | 9/1980 | Sybertz | 144/230 |
| 4,271,882 | A | | 6/1981 | Valo | |
| 4,327,789 | A | | 5/1982 | Reuter | |
| 4,335,767 | A | | 6/1982 | Reuter | |
| 4,351,487 | A | | 9/1982 | Haller et al. | |
| 4,545,413 | A | * | 10/1985 | Sundberg et al. | 144/241 |
| 4,610,285 | A | | 9/1986 | Derivaz | |
| 4,848,427 | A | | 7/1989 | Reuter | |
| 5,271,440 | A | | 12/1993 | Bradstreet, Jr. et al. | |
| 5,421,386 | A | | 6/1995 | Lundstrom | |
| 5,469,902 | A | * | 11/1995 | Sharp et al. | 144/241 |
| 5,564,967 | A | * | 10/1996 | Jorgensen | 451/45 |
| 5,617,908 | A | | 4/1997 | Toogood | |
| 5,709,255 | A | | 1/1998 | Toogood | |
| 5,816,301 | A | | 10/1998 | Stager | |
| 5,819,826 | A | * | 10/1998 | Schmatjen | 144/241 |
| 5,904,193 | A | * | 5/1999 | Kellner | 144/230 |
| 5,979,522 | A | * | 11/1999 | Swartwood | 144/218 |

(Continued)

FOREIGN PATENT DOCUMENTS

| | | |
|---|---|---|
| AT | 397 629 B | 2/1990 |
| FR | 2760674 | 3/1997 |

*Primary Examiner*—Derris H. Banks
*Assistant Examiner*—Shelley Self
(74) *Attorney, Agent, or Firm*—Birdwell & Janke, LLP

(57) ABSTRACT

A knife and apparatus for clamping the knife. The knife has front and back sides that, preferably, both include interlocking features adapted for interlocking engagement with corresponding inner and outer clamping members, to prevent slippage of the knife from the clamping members in orientations wherein the knife rests thereon in the chipping apparatus when the knife is unclamped. Preferably, the interlocking feature of the back side of the knife includes a semi-cylindrical groove, and the interlocking feature of the front side of the knife includes two spaced-apart deflector ridges. Preferably, the interlocking feature of the outer clamping member is a projection having a semi-cylindrical tip portion wherein the semi-cylindrical shape is preferably half-cylindrical, and wherein the projection extends from an inner surface of the outer clamping member sufficiently far that most of the back side of the knife does not make contact therewith.

24 Claims, 3 Drawing Sheets

U.S. PATENT DOCUMENTS 6,058,989 A * 5/2000 LaGrange et al. ..... 144/230
6,058,992 A 5/2000 Stager et al.
6,131,627 A * 10/2000 Zaiser ..... 144/241
6,167,929 B1 1/2001 Stager et al.

* cited by examiner

KNIFE AND APPARATUS FOR CLAMPING A KNIFE

BACKGROUND OF THE INVENTION

The present invention relates to a knife and apparatus for clamping a knife in a wood chipper, such as a disc, drum or conical head chipper for use in the commercial processing of logs.

In wood chipping apparatus used in the forest products industry, a rotating member is provided for receiving replaceable knives for cutting chips from the log. Each knife is typically clamped to the rotating member between an outer clamping member and an inner clamping member or counterknife, wherein the knife and counterknife together form a surface against which the log is forced to remove chips from the log. The chips themselves have commercial value, and their removal shapes the log into lumber and finishes its surface. The clamping members essentially form a cassette for the knife, although the entire cassette is often referred to in the trade as a knife. Herein, the term "knife" is used to refer to the blade that is clamped between the outer and inner clamping members.

The spacing between the outer and inner clamping members is adjustable for loading the knife into the apparatus, or unloading the knife from the apparatus, such as for replacing the knife or turning the knife end-to-end to position an alternative knife edge in the chipper. A preferred mechanism for adjusting the spacing between an outer clamping member an inner clamping member is described in U.S. Pat. No. 5,979,522, also incorporated herein by reference in its entirety.

As one example of a wood chipping apparatus, a chipper disc typically spins in a vertical plane. A number of identical knives are spaced around the periphery of the disc. The knives are elongate, and their elongate axes are oriented along radial lines passing approximately through the center of the disc, the axis of each knife becoming horizontal at respective 9:00 and 3:00 positions of the disc. When unclamped, the knives are typically unrestrained from sliding along these radial lines, so it is preferable to unclamp the knives when they are at least approximately in one of these two level positions.

A shroud is typically provided that covers the disc to retain chips and to shield personnel, the shroud including a closeable opening in a predetermined angular position of rotation of the disc, to provide access to a knife that has become aligned therewith. The position of the opening is selected so that the heavy and sharp knife will not slip forwardly out of the apparatus when it is unclamped; however, even so, the knife remains free to slip backwardly into the apparatus and still presents some risk of injury or damage. Such considerations are important as well to other types of wood chippers, such as the drum and conical head chippers.

Accordingly, there is a need for a knife and apparatus for clamping the knife in a chipping apparatus that provides for more safely and securely preventing movement of an unclamped knife along a line of slippage extending into and out of the apparatus.

SUMMARY OF THE INVENTION

A knife and apparatus for clamping the knife according to the present invention solves the aforementioned problem and meets the aforementioned need by providing an elongate knife having front and back sides co-terminating in a cutting edge, and outer and inner clamping members for clamping the knife therebetween adapted to receive, respectively, the back and front side of the knife. The back side of the knife and the outer clamping member have mutually interlocking features to prevent slippage of the knife from the outer clamping member in orientations wherein the knife rests thereon in the chipping apparatus when the knife is unclamped.

The front side of the knife and the inner clamping member preferably also have mutually interlocking features to prevent slippage of the knife from the inner clamping member in orientations wherein the knife rests thereon in the chipping apparatus when the knife is unclamped.

In one aspect of the invention, the interlocking feature of the back side of the knife includes at least one semi-cylindrical groove, wherein the knife is preferably bilaterally symmetric about a plane parallel to the elongate axis of the knife and wherein the semi-cylindrical shape is preferably half-cylindrical.

In another aspect of the invention, the interlocking feature of the outer clamping member is a projection having a semi-cylindrical tip portion wherein the semi-cylindrical shape is preferably half-cylindrical.

In yet another aspect of the invention, the projection of the outer clamping member extends from an inner surface thereof sufficiently far that most of the back side of the knife does not make contact therewith, to better control the point of application of clamping force.

Where the tip portion of the projection is semi-cylindrical, a degree of rotation of the knife about the projection is permitted which facilitates installation of the knife and which accommodates a greater degree of dimensional variance in the mating parts, further facilitating installation of the knife as well as reducing manufacturing costs.

Therefore, it is a principal object of the present invention to provide a novel and improved knife and apparatus for clamping the knife.

It is another object of the present invention to provide a knife and apparatus for clamping the knife that provides for more safely holding the knife in position in a chipping apparatus when the knife is unclamped therein.

It is yet another object of the present invention to provide a knife and apparatus for clamping the knife that provides for more securely holding the knife in position in the chipping apparatus when the knife is unclamped therein.

It is still another object of the present invention to provide a knife and apparatus for clamping the knife that facilitates installation and removal of the knife from the chipping apparatus.

It is a further object of the present invention to provide a knife and apparatus for clamping the knife that provides for reduced manufacturing costs of the knife and clamping members.

It is still a further object of the present invention to provide a knife and apparatus for clamping the knife that provides for increased control over the application of clamping force to the knife.

The foregoing and other objects, features and advantages of the present invention will be more readily understood upon consideration of the following detailed description of the invention, taken in conjunction with the following drawings.

BRIEF DESCRIPTION OF THE DRAWINGS

FIG. 5A is a pictorial view, corresponding to FIG. 1A, of a knife according to the present invention that illustrates an alternative to the knife shown therein.

FIG. 5B is a pictorial view, corresponding to FIG. 1B, of a knife according to the present invention that illustrates an alternative to the knife shown therein.

DETAILED DESCRIPTION OF A PREFERRED EMBODIMENT

Figure 1A:
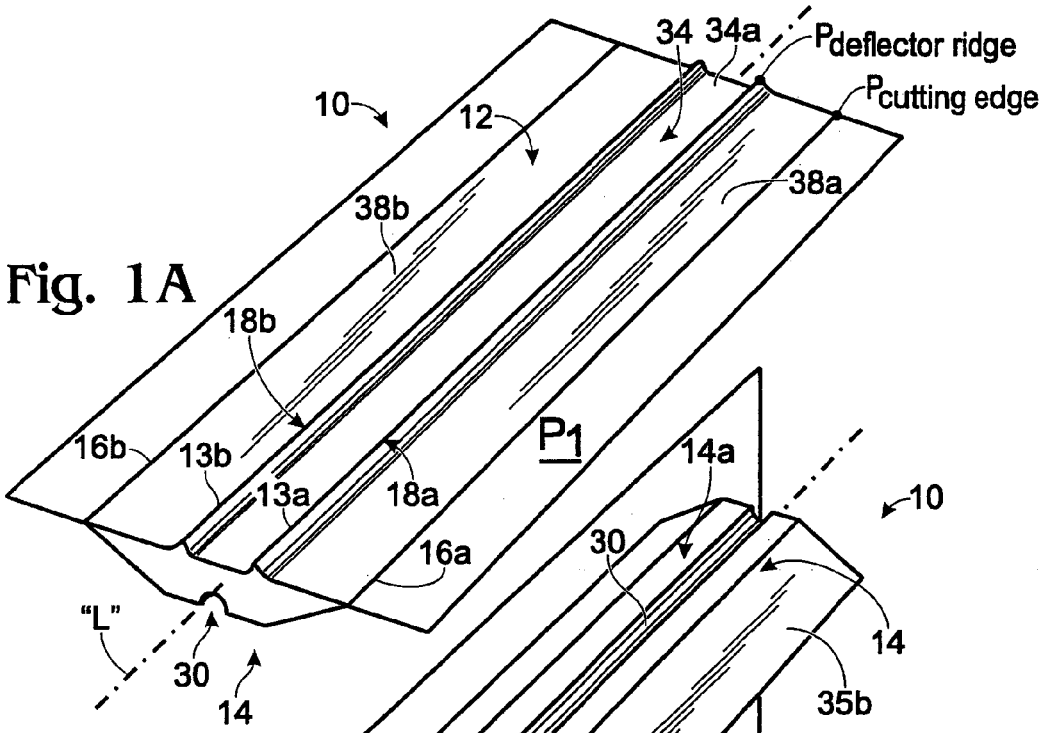
FIG. 1A is a pictorial view of a knife according to the present invention, showing is a front side of the knife in perspective.
Figure 1B:
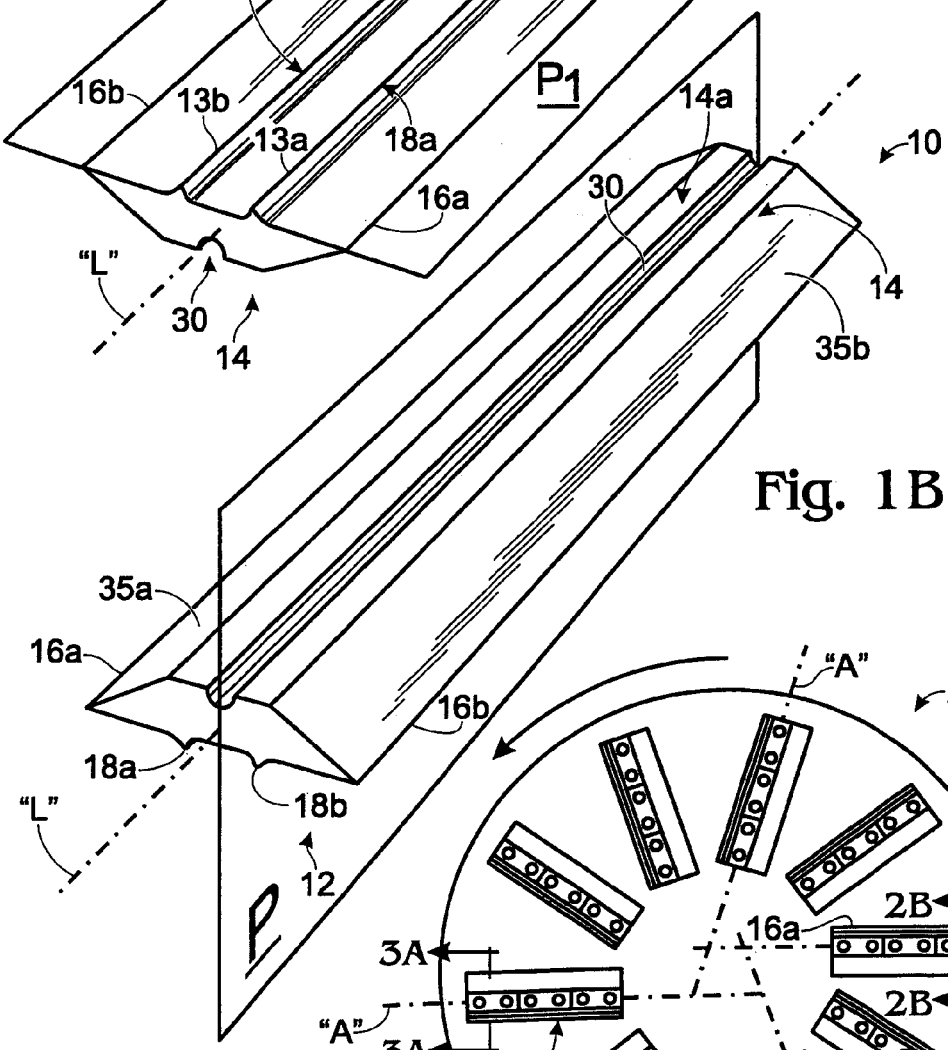
FIG. 1B is a pictorial view of the knife of FIG. 1 showing a back side of the knife in perspective.

Referring to FIGS. 1A and 1B, a preferred knife 10 is shown modified according to the present invention. The knife without modification has been widely available as manufactured by Key Knife, Inc., of Tualatin, Oreg., and is described in detail in Schmatjen, U.S. Pat. No. 5,819,826, herein incorporated by reference in its entirety. The knife 10 may be employed in any wood chipping apparatus, such as a disc, drum or conical head wood chipper. The knife has an elongate axis "L", a front side 12 and a back side 14.

The front side 12 of the knife 10 includes spaced deflector ridges 18*a* and 18*b* that project therefrom. Each of the deflector ridges 18*a* and 18*b* is characterized by a single linear edge 13*a* and 13*b* respectively (FIG. 1A). The deflector ridges define a channel 34 having a channel surface 34*a*. The channel 34 is effectively a recess in the front side of the knife, which may be provided in other configurations, such as a keyway. The deflector ridges also define two lower knife-edge-joining portions 38*a* and 38*b* that terminate in respective cutting edges 16*a* and 16*b*. The cutting edges 16*a* and 16*b* lie in a plane "$P_l$" and the edges 13*a*and 13*b*of the deflector ridges are maximally spaced from the plane "$P_l$." As is most readily apparent in FIG. 1A, the lower knife-edge-joining portions 38*a* and 38*b* provide smoothly curving transitions between the associated linear edges 13*a* and 13*b* and the respective corresponding cutting edges 16*a* and 16*b*. Particularly, with reference (for example) to the knife-edge-joining portion 38*a*, the knife-edge-joining portion provides a smoothly curving transition between a point "$P_{deflector\text{-}ridge}$" on the linear edge 13*a* and a point "$P_{cutting\text{-}edge}$" on the cutting edge 16*a*.

The back side 14 of the knife 10 includes a clamp-facing surface portion 14*a* that is substantially planar and parallel to the channel surface 34*a*, and two upper knife-edge-joining portions 35*a* and 35*b* that slope from opposite edges of the clamp-facing surface portion to the cutting edges 16*a* and 16*b*. The knife 10 is typically provided so that the lower knife-edge-joining portion 38*a* lies in the same plane as the lower knife-edge-joining portion 38*b* (and the channel surface 34*a*); however, these faces can be ground or otherwise provided according to the aforementioned companion application entitled METHOD AND APPARATUS FOR CLAMPING A KNIFE so that the lower knife-edge-joining portions are not coplanar.

As mentioned previously, the above features are described in the '826 Patent. While the invention is believed to provide maximum advantage when used in connection with the preferred knife, the invention will provide an advantage when used with other prior art knives as well, such as knives that do not have all of the aforementioned features, or knives which include additional features.

Figure 2A:
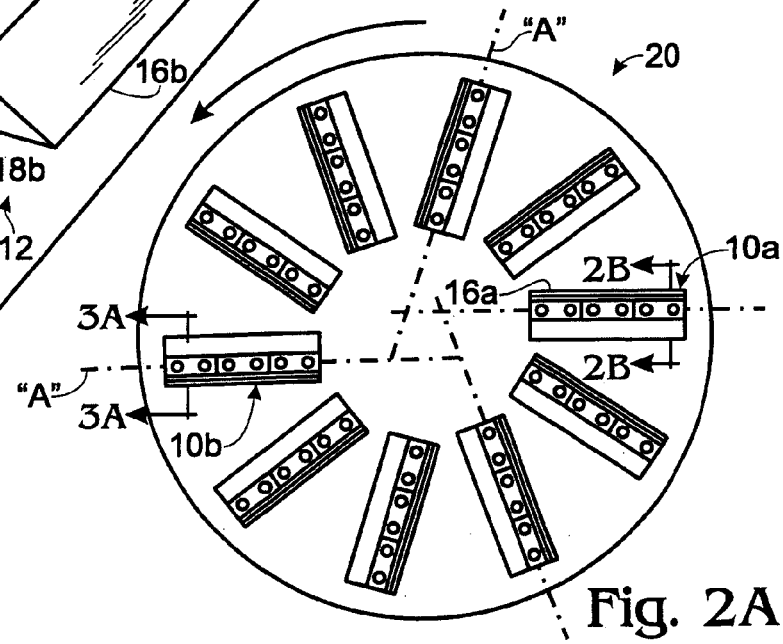
FIG. 2A is an elevation of a disc chipper including a plurality of knives such as that shown in FIGS. 1A and 1B.

Referring to FIG. 2A, a disc chipper 20 is shown employing a plurality of the knives 10. While a disc chipper is used herein to illustrate use of particular embodiments of the invention, the principles of the invention apply equally to other chipping apparatus including that employing a drum or a "conical" head, and application of those principles to alternative configurations of chipping apparatus will be readily apparent to those of ordinary skill in the art.

The knives are elongate, meaning herein that they have a shape in a cross-sectional plane that is maintained for some distance along an axis "A" that is perpendicular to the plane. For use in a disc chipper, the length of the knives along the axis "A" is typically large in comparison to the cross-sectional dimensions of the knives; however, the length of the knives may be small in comparison to these dimensions, such as where many discs are combined to form a drum in a drum chipping apparatus. In the disc chipper, the elongate axes "A" extend radially, approximately from the center of the disc. The disc spins in a vertical plane in the direction of the arrow, with an exposed cutting edge 16*a* of each knife being visible.

Figure 2B:
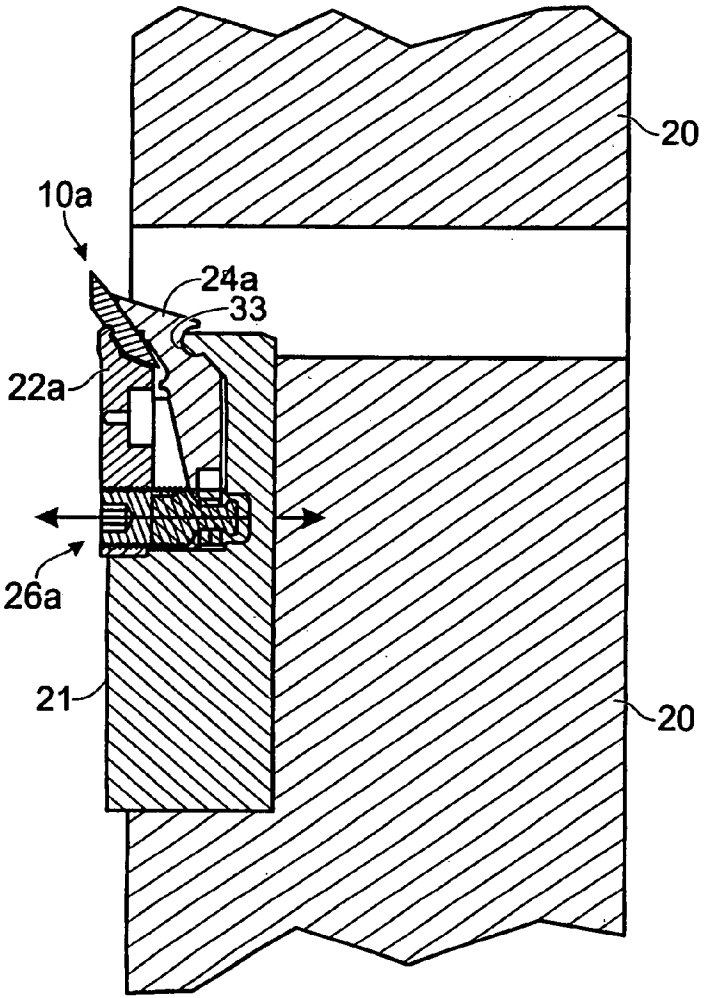
FIG. 2B is a cross-section of the disc chipper of FIG. 2A, taken through a knife that is in the 3:00 position of the disc along a line 2B—2B, showing the knife clamped in the disc chipper.

FIG. 2B shows a cross-section of the disc chipper 20 taken through a particular knife 10*a* that is in the 3:00 position of the disc as it is shown in FIG. 2A. The knife is shown clamped in the disc chipper between outer and inner clamping members 22*a* and 24*a* respectively, so that the disc is ready for use for cutting wood. The inner clamping member is often referred to as a "counterknife."

An insert 21 is received in a corresponding pocket in the disc chipper. The insert supports the outer and inner clamping members as well as means for adjusting the spacing between the clamping members for clamping and unclamping the knife. For clamping the knife as shown, at least a portion of the channel surface 34*a* (FIG. 1A) is abuttably received by the inner clamping member 24*a*, and the clamp-facing surface portion 14*a* of the back side 14 of the knife (FIG. 1B) is at least disposed proximate to (FIG. 4B) and may be abuttably received by an inner surface 23 (FIG. 3A) of the outer clamping member 22*a*.

Preferably, the outer clamping member 22*a* is fixedly disposed with respect to the insert 21, and a threaded adjustment member 26*a* is received in a corresponding threaded aperture through the outer clamping member which permits translating the adjustment member in the directions indicated by the arrows, for adjustably pivoting the inner clamping member 24*a* about a bearing surface 33 that is provided as part of the insert 21. Alternatively, the position of the inner clamping member may be fixed and the outer clamping member may be adapted to be adjustably spaced apart therefrom, and either or both clamping members may be adjustably movable by any desired means without departing from the principles of the invention.

Figure 3A:
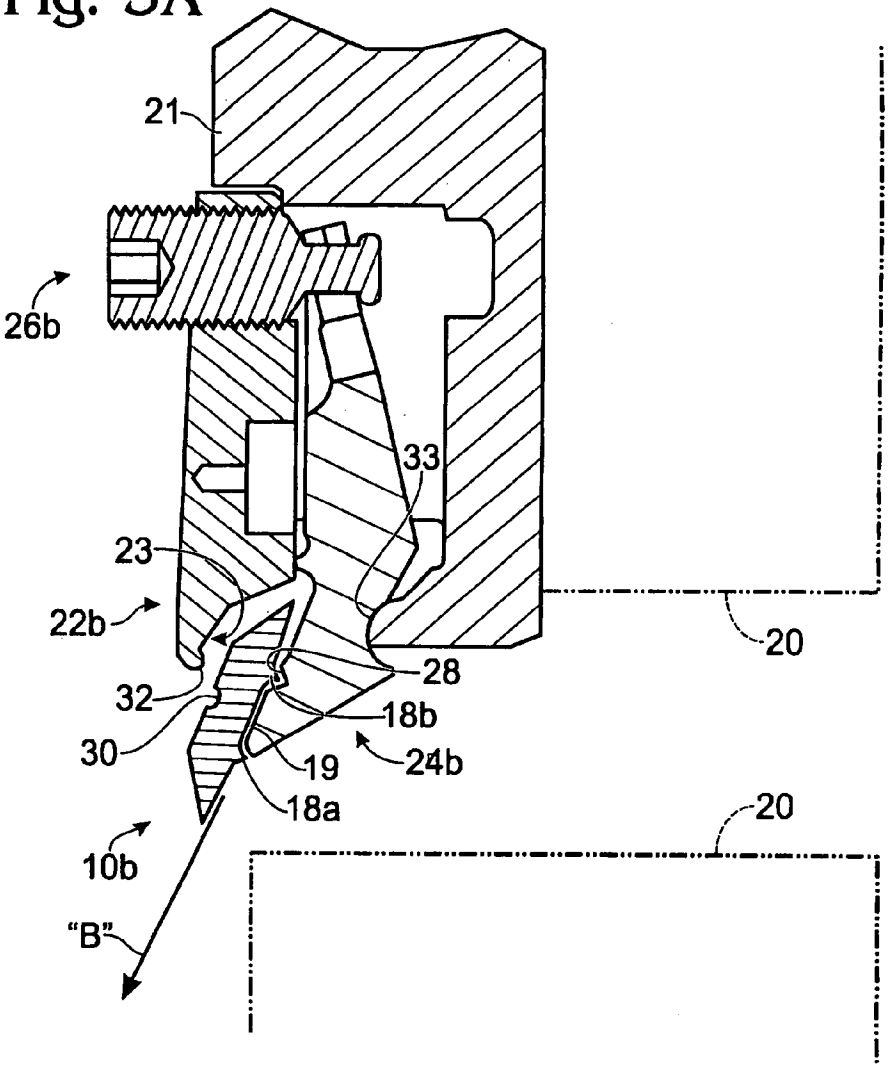
FIG. 3A is a cross-section of the disc chipper of FIG. 2B, taken through another knife that is in the 9:00 position of the disc along a line 3A—3A thereof, showing the knife unclamped in the disc chipper.

Turning to FIG. 3A, a cross-section similar to that of FIG. 2B shows another knife 10*b* (see also FIG. 2A) which is in the 9:00 position of the disc. By contrast to the knife 10*a* in FIG. 2B, the knife 10*b* is unclamped in the disc chipper. The inner clamping member 24*b* for the knife 10*b* has been pivoted about the surface 33 to provide a spacing from the outer clamping member 22*b* that is sufficient for removing the knife from, or installing the same knife or a different knife, between the clamping members. When the clamping members 22*b* and 24*b* are separated, the knife 10*b* in the 9:00 position rests on the inner clamping member 24*b* under the influence of gravity.

More particularly, one of the deflector ridges 18*a* is disposed outside a toe 19 of the inner clamping member 24*b* at one end of the toe, the other end of the toe being defined by a recess 28 shaped to receive the other of the other deflector ridge 18*b*. The channel 34 as bounded by the deflector ridges defines a recess that, along with the relatively projecting toe of the inner clamping member, provide interlocking means which cooperate to hold the knife 10*b* to the inner clamping member 24*b* against the influence of gravity when the knife is unclamped in the 9:00 position of the disc. Alternatively, a keyway may be provided in the knife for receiving the toe. However, if the knife is dislodged, it may fall outwardly from the disc chipper along a line of slippage "B," posing a substantial risk of injury or damage.

Interlocking the knife to the inner clamping member also provides for locating and positioning the knife ("indexing") so that it is accurately disposed for cutting when the clamping members are adjusted to clamp the knife therebetween.

Figure 3B:
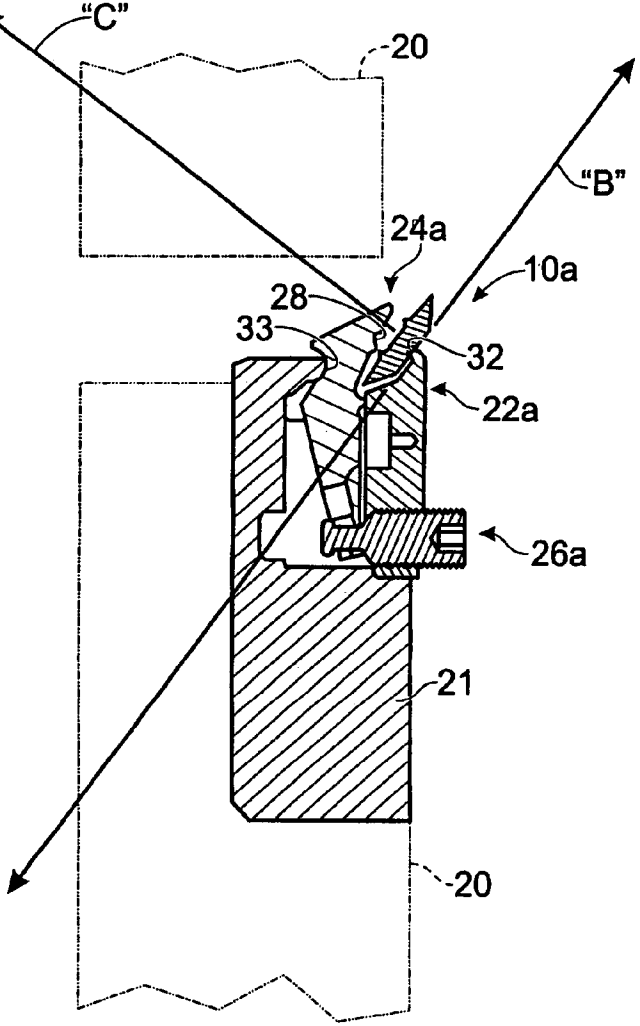
FIG. 3B is a cross-section of the disc chipper and knife of FIG. 2B, showing the knife in the 3:00 position unclamped in the disc chipper.

Turning to FIG. 3B, a cross-section similar to that shown in FIG. 2B illustrates the knife 10*a* unclamped in the disc chipper in the 3:00 position of the disc. The inner clamping member 24*a* has been pivoted about the surface 33 to provide a spacing from the outer clamping member 22*a* that is sufficient for removing the knife from, or installing the same knife or a different knife, between the clamping members. When the clamping members 22*a* and 24*a* are separated, such as by use of the adjustment mechanism 26*a*, the knife 10*a* in the 3:00 position of the disc rests on the outer clamping member 24*a* under the influence of gravity as shown. It may be noted that the clamping members need not be maximally separated for this result to occur, the clamping members becoming separated at the point that the clamping force they exert on the knife is reduced to zero.

The knife 10*a* in the 3:00 position cannot be interlocked with the inner clamping member 24, hence the safety and indexing features provided by the deflector ridges of the knife and the recess 28 of the inner clamping member are lost in this position. Thence, the unclamped knife in the 3:00 position of the disc will ordinarily slip backwardly into the apparatus along the line of slippage "B," against interior portions of the outer and inner clamping members. While the risk of injury to personnel is much reduced as compared to that posed by slippage of the knife in the 9:00 position, such slippage may cause damage to the knife or the apparatus, and may make removal of the knife somewhat difficult. Moreover, installation of the knife is also difficult, and indexing the knife into proper position while clamping the knife is very difficult.

With additional reference to FIG. 1A, to improve the safety and security of holding the unclamped knife in the 3:00 position of the disc as well as to provide for indexing of the knife, the knife and outer clamping members are provided with interlocking features to prevent slippage of the knife into or out of the apparatus along the axis "B" (FIG. 3B) when the knife is unclamped, providing an outstanding advantage over the prior art.

In a preferred embodiment of the invention, the otherwise substantially planar clamp-facing surface portion 14*a* of the back side 14 of the knife includes a recess 30 that is particularly a groove, and the outer clamping member 22 includes a complementary elongate projection 32 adapted to fit into the groove, where persons of ordinary skill will immediately recognize the equivalence of providing the knife with a projection and the outer clamping member 22 with a complementary and corresponding groove. According to the invention, the interlocking features of the knife and outer clamping member may be any interlockingly cooperating male or female structures that permit removing the knife from the outer clamping member while preventing the aforementioned slippage.

Preferably, the interlocking features interlock or retain one another in the direction or plane of slippage "B" while providing for free movement of the knife in one or both perpendicular directions. As mentioned, the recess 30 and projection 32 are preferably elongate, and at least a portion of each is preferably semi-circular as seen in a cross-section perpendicular to the elongate axis "L" (FIG. 1A), to provide surfaces that are semi-cylindrical. Most preferably and particularly as shown, the shape of the recess 30 and the shape of a distal tip 27 (best seen in FIG. 4B) of the projection in cross-section are half-circular, to provide surfaces that are half-cylindrical.

These shapes are believed to be especially advantageous for easing installation of the knife, by permitting the knife to pivot on the projection about the elongate axis of the knife which facilitates manipulating the knife into position, and by accommodating greater manufacturing tolerances, which further reduces the effort required to place the knife into position as well as manufacturing costs.

Figure 4A:
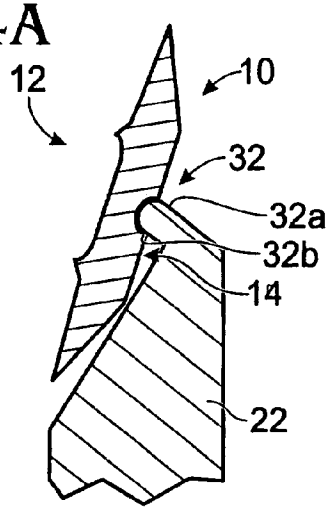
FIG. 4A is a partial cross-section, corresponding to the cross-section of FIG. 3B in the 3:00 position, of a knife and outer clamping member according to the present invention.
Figure 4B:
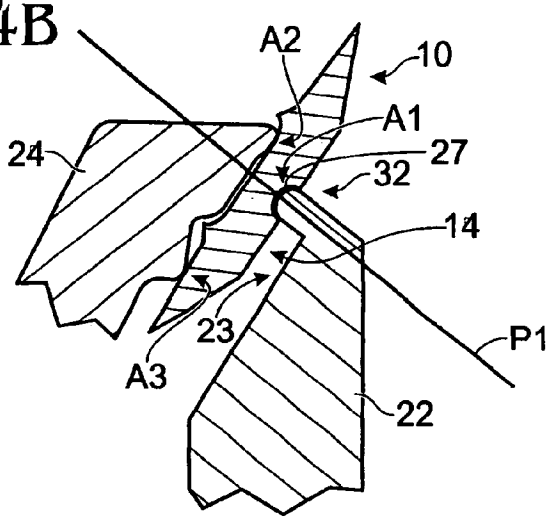
FIG. 4B is a partial cross-section of the knife and outer clamping member of FIG. 4A, showing the knife clamped between the outer clamping member and an inner clamping member.

Referring to FIGS. 4A and 4B, the preferred form of the interlocking features provides that the projection 32 extends far enough from the inner surface 23 of the outer clamping member so that a "three-point" contact is provided for clamping the knife, wherein the projection 32 provides one of the points of contact. In FIG. 4A, the inner clamping member 24 has been moved away from the outer clamping member 22, and the knife 10 is held loosely by the projection 32. In FIG. 4B, the clamping member 24 has been pivoted to receive the front side 12 of the knife and clamp the knife to the projection 32 of the clamping member 22, wherein the projection 32 has sides 32*a* and 32*b* that are substantially perpendicular to the inner surface 23 of the clamping member 22, terminating in a tip 27 having the semi-circular cross-section, and extending far enough from the surface 23 so that the knife can rotate (compare FIGS. 4A and 4B) about its elongate axis at the tip 27, and so that the back side of the knife is not otherwise in contact with the surface 23 when the knife is clamped (FIG. 4B).

Permitting a minimal but significant ("substantial") degree of rotation of the knife on the projection facilitates installation of the knife while not defeating the purpose of the projection to interlock with the recess 30 to prevent slippage. The semi-cylindrical surface of the projection may extend over an arc that is greater or less than a half-cylindrical 180 degrees, while the semi-cylindrical surface of the recess 30 should have an arc that is about 180 degrees or less, to prevent the recess 30 from pinching or capturing the projection, which would decrease the efficacy of the connection between the parts and make both removal and installation of the knife difficult.

As mentioned, providing that most of the back side of the knife does not contact the surface 23 when the knife is clamped provides for a "three-point" contact, i.e., a point of contact "A1" at the tip 27 falls between, with respect to a line "P1," two other points of contact "A2" and "A3," so that contact is not being made, and force is not being transmitted, between most of the back side of the knife 14 and the clamping member 22. This provides a means for applying the clamping force that is consistent in spite of manufacturing variations in the dimensions of the parts.

The semi-cylindrical shapes for the projection and recess 30 are also believed to decrease manufacturing cost by rendering the capability to index the knife accurately to the outer clamping member less sensitive to manufacturing tolerances in these features.

While in the preferred embodiment these features extend over the entire length of the knife (determined in the direction of the axis "L"), this is not essential, and it may provide some additional indexing capability to limit the lateral extent of the interlocking features, so that the knife is retained laterally (into and out of the plane of FIG. 3A) as well as with respect to slippage in the direction or plane "B." However, the knife may be freely moved away from the inner clamping member 22*a* along the perpendicular direction "C," for changing the knife.

Preferably, the interlocking feature of the knife is located so that the knife is or remains bilaterally symmetric with respect a plane "P" (FIG. 1B) that is parallel to the elongate axis of the knife, so that the knife may be turned end-to-end in a perpendicular plane, rather than rotated about the elongate axis, such as is required in Valo, U.S. Pat. No. 4,271,882 or Svensson, U.S. Pat. No. 4,047,670, for example, to obtain a fresh cutting edge from the knife. In view of the sharp edges of the knives and their great weight, it is believed that the former operation is easier to perform than the latter as it can be performed without touching the cutting edges, without holding both sides of the knife, and without requiring a rotation of the wrist.

It should be noted that to provide such symmetry does not require a single interlocking feature that is centered on or in the back side 14 of the knife such as shown in FIG. 1B. For example, bilateral symmetry with respect to the plane "P" may be obtained by providing an interlocking feature of the knife consisting of two, or any even number of recesses 30 that are symmetrically disposed with respect to the plane, either alone or in combination with a recess 30 that is centrally disposed in the plane. This provides the option of applying clamping force to the back side of the knife off its center.

To permit the aforementioned pivoting of the knife about the projection, it is preferable that only one projection is provided that is adapted to be received in just one of the one or more recesses 30 that are provided. However, providing this advantage is not essential, and additional projections may be provided without departing from the principles of the invention.

Other forms and shapes of the interlocking features may be provided also without departing from the principles of the invention. For example, the one or more projections could be formed as pins and the one or more recesses as complementary apertures, holes or cavities providing for free movement along the axis "C" even though sliding the knife laterally is not permitted without first separating the pins from the holes by movement of the knife along the axis "C." A similar effect is obtained, as mentioned above, by forming the preferred groove so that it does not extend the entire length of the knife.

Provision of the recesses 30 (FIG. 3A) and projections 32 makes it particularly advantageous to access the knife for changing or other purposes at the 3:00 position of the disc. According to the invention, then, the opening in the shroud is preferably situated at this position. Moreover, providing the interlocking features of the knife and outer clamping member in combination with the interlocking features of the knife and counterknife provides for safely holding the knife in the apparatus as well as indexing the knife to the apparatus in either or both the 9:00 and 3:00 positions of the disc, resulting in outstanding flexibility.

It is to be recognized that, while a specific method and apparatus for clamping a knife has been shown and described as preferred, other configurations could be utilized, in addition to configurations already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

What is claimed is:

1. A wood chipping apparatus, comprising:

a knife having a back side, said back side having a first semi-cylindrical interlocking feature therein, and a front side, wherein said front and back sides co-terminate in two spaced apart cutting edges lying in a plane, said front side including, in correspondence with said cutting edges, a respective two spaced apart and similar projecting interlocking features that project a maximum distance from said plane, and an inner clamping member comprising a projection terminating in a second semi-cylindrical interlocking feature that is complementary in form to said first interlocking feature for engagement therewith, for clamping said knife in the wood chipping apparatus, said projection extending from said inner clamping member so as to permit rotation of said knife relative thereto during said engagement.

2. The apparatus of claim 1, wherein said projecting interlocking features include, corresponding with said cutting edges, two spaced apart deflector ridges projecting away from said front side a maximum distance from said plane.

3. The apparatus of claim 2, further comprising an outer clamping member adapted to interlockingly receive at least one of said deflector ridges during said engagement.

4. The apparatus of claim 2, wherein said first semi-cylindrical interlocking feature is a recess, and wherein said second semi-cylindrical interlocking feature is convex.

5. The apparatus of claim 1 the apparatus further comprising an outer clamping member adapted to interlockingly receive at least one of said projecting interlocking features.

6. A wood chipping apparatus, comprising:

a knife having a back side, said back side having a first semi-cylindrical interlocking feature therein, and a front side, wherein said front and back sides co-terminate in two spaced apart cutting edges lying in a plane, said front side including, in correspondence with said cutting edges, a respective two spaced apart and similar projecting interlocking features that project a maximum distance from said plane, and a clamp for clamping said knife by applying a clamping force thereto, said clamp comprising a projection terminating in a second semi-cylindrical interlocking feature that is complementary in form to said first interlocking feature for engagement therewith, substantially the entirety of said clamping force being transmitted through said engagement.

7. The apparatus of claim 6, wherein said projecting interlocking features include, corresponding with said cutting edges, two spaced apart deflector ridges projecting away from said front side a maximum distance from said plane.

8. The apparatus of claim 7, further comprising an outer clamping member adapted to interlockingly receive at least one of said deflector ridges during said engagement.

9. The apparatus of claim 7, wherein said first semi-cylindrical interlocking feature is a recess, and wherein said second semi-cylindrical interlocking feature is convex.

10. The apparatus of claim 6 the apparatus further comprising an outer clamping member adapted to interlockingly receive at least one of said projecting interlocking features.

11. The apparatus of claim 4, wherein each said deflector ridge terminates in a single linear edge disposed said maximum distance from said plane.

12. The apparatus of claim 4, wherein each of said deflector ridges defines an associated knife-edge-joining portion providing a smoothly curving transition from a point on the deflector ridge that is disposed from said plane said maximum distance to a corresponding point on the corresponding cutting edge.

13. The apparatus of claim 3, wherein each said deflector ridge terminates in a single linear edge disposed said maximum distance from said plane.

14. The apparatus of claim 3, wherein each of said deflector ridges defines an associated knife-edge-joining portion providing a smoothly curving transition from a point on the deflector ridge that is disposed from said plane said maximum distance to a corresponding point on the corresponding cutting edge.

15. The apparatus of claim 2, wherein each said deflector ridge terminates in a single linear edge disposed said maximum distance from said plane.

16. The apparatus of claim 2, wherein each of said deflector ridges defines an associated knife-edge-joining portion providing a smoothly curving transition from a point on the deflector ridge that is disposed from said plane said maximum distance to a corresponding point on the corresponding cutting edge.

17. The apparatus of claim 9, wherein each said deflector ridge terminates in a single linear edge disposed said maximum distance from said plane.

18. The apparatus of claim 9, wherein each of said deflector ridges defines an associated knife-edge-joining portion providing a smoothly curving transition from a point on the deflector ridge that is disposed from said plane said maximum distance to a corresponding point on the corresponding cutting edge.

19. The apparatus of claim 8, wherein each said deflector ridge terminates in a single linear edge disposed said maximum distance from said plane.

20. The apparatus of claim 8, wherein each of said deflector ridges defines an associated knife-edge-joining portion providing a smoothly curving transition from a point on the deflector ridge that is disposed from said plane said maximum distance to a corresponding point on the corresponding cutting edge.

21. The apparatus of claim 7, wherein each said deflector ridge terminates in a single linear edge disposed said maximum distance from said plane.

22. The apparatus of claim 7, wherein each of said deflector ridges defines an associated knife-edge-joining portion providing a smoothly curving transition from a point on the deflector ridge that is disposed from said plane said maximum distance to a corresponding point on the corresponding cutting edge.

23. The apparatus of claim 1, wherein said first semi-cylindrical interlocking feature is a recess, and wherein said second semi-cylindrical interlocking feature is convexly curved.

24. The apparatus of claim 6, wherein said first semi-cylindrical interlocking feature is a recess, and wherein said second semi-cylindrical interlocking feature is convexly curved.

* * * * *

UNITED STATES PATENT AND TRADEMARK OFFICE

CERTIFICATE OF CORRECTION

PATENT NO. : 6,968,879 B2
DATED : November 29, 2005
INVENTOR(S) : Loren R. Schuh et al.

It is certified that error appears in the above-identified patent and that said Letters Patent is hereby corrected as shown below:

Column 8,
Lines 39 and 44, delete “inner” and replace with -- outer --;
Lines 52 and 59, delete “outer” and replace with -- inner --.

Column 9,
Lines 15 and 22, delete “outer” and replace with -- inner --.

Signed and Sealed this

Seventh Day of March, 2006

JON W. DUDAS
*Director of the United States Patent and Trademark Office*